US006283516B1

(12) United States Patent
Viney

(10) Patent No.: US 6,283,516 B1
(45) Date of Patent: Sep. 4, 2001

(54) LOCK MECHANISM

(75) Inventor: Bernard John Viney, Berkshire (GB)

(73) Assignee: Surelock McGill Limited, Berkshire (GB)

( * ) Notice: Subject to any disclaimer, the term of this patent is extended or adjusted under 35 U.S.C. 154(b) by 0 days.

(21) Appl. No.: 09/306,859

(22) Filed: May 7, 1999

(30) Foreign Application Priority Data

May 8, 1998 (GB) ..... 9809936

(51) Int. Cl.[7] ..... E05C 1/06
(52) U.S. Cl. ..... 292/160; 292/39
(58) Field of Search ..... 292/39, 34, 160, 292/DIG. 44, 92; 70/118, 120, 418

(56) References Cited

U.S. PATENT DOCUMENTS

| | | | | |
|---|---|---|---|---|
| T978,006 | | 1/1979 | Carman et al. | 292/41 |
| 1,968,285 | * | 7/1934 | Egan | 292/172 |
| 2,594,253 | * | 4/1952 | Veer | 292/92 |
| 2,823,536 | * | 2/1958 | Watson | 70/1.5 |
| 3,637,277 | * | 1/1972 | Krug | 70/417 |
| 4,248,452 | * | 2/1981 | Allenbaugh | 292/167 |
| 4,799,718 | | 1/1989 | Ing | 292/36 |
| 5,570,913 | * | 11/1996 | Puric | 292/36 |
| 5,603,534 | * | 2/1997 | Fuller | 292/39 |
| 5,683,122 | * | 11/1997 | Lee | 292/39 |
| 5,865,479 | * | 2/1999 | Viney | 292/39 |

FOREIGN PATENT DOCUMENTS

| | | |
|---|---|---|
| 1364444 | 8/1974 | (GB) . |
| 2 096 686 | 10/1982 | (GB) . |
| WO 97/35084 | 9/1997 | (WO) . |

* cited by examiner

*Primary Examiner*—Gary W. Estremsky
(74) *Attorney, Agent, or Firm*—Joseph R. Kelly; Westman, Champlin & Kelly, P.A.

(57) ABSTRACT

There is described a lock mechanism for a leaf hinged within a frame, the lock mechanism comprising a first bolt and at least one further bolt, each bolt being movable between an engaged position in which a distal end of the bolt projects from the leaf and a disengaged position, the bolts being directly driveable together between the engaged and disengaged positions by movement of a common drive member, the first bolt having a proximal end engaged by the drive member and isolating means for ensuring that, when pressure is applied to the distal end of the first bolt tending to move it to the disengaged position, the or each further bolt is not moved to the disengaged position.

2 Claims, 8 Drawing Sheets

LOCK MECHANISM

The present invention relates to a lock mechanism.

BACKGROUND OF THE INVENTION

Locks which provide security on one side and easy and quick operation from the other side are used widely, particularly for doors providing an emergency exit from a building.

Commonly such locks use an engineered rack and pinion operating mechanism to operate several strong bolts simultaneously to secure the door. The door is thus secured at various points around its perimeter to provide security and prevent access from one side of the door. When such a door is an emergency exit it is necessary to comply with safety requirements to provide an operating lever inside which will operate by a single simple movement to retract the bolts and unlock the door to allow a safe and quick exit through the door from the building. Typically, a horizontal bar is provided on such doors for the operation of the lock mechanism.

Thus for lock mechanisms used for such doors there are conflicting requirements. One requirement is the security to prevent access from one side whilst the other requirement is a safety requirement to provide for simple and quick operation of the lock mechanism from the inside to allow the door to be unlocked quickly in an emergency.

The lock mechanisms currently available with a direct drive mechanism to the bolts such as a rack and pinion do not provide adequate security since they do not provide resistance to the application of pressure to the ends of the bolts.

GB-A-2289084 disclose a lock mechanism for use on a door hinged in a door frame at a first side. The lock mechanism comprises bolt members moveable between an engaged position in the door frame and a disengaged position. The bolt members are arranged to engage said door frame from at least two of the sides of said door which are not hinged. Latch means are arranged to prevent movement of at least one of the bolt members from the engaged position to the disengaged position. A latch release arrangement is used to disengage the latch means and allow movement of the bolt member. The latch release arrangement and the bolt members are arranged to be operable in response to a single movement of an operating member to allow the latch means to be disengaged and the bolt members to be disengaged from said engaged position. The bolt members are arranged to be directly driven between said engaged and disengaged positions by movement of the operating member.

The lock mechanism of GB-A-2289084 utilises a direct drive mechanism between the operating member, e.g. a handle, and the bolt members providing for positive and visible locking since the position of the operating member will indicate whether the bolt members are properly engaged or not. Such a direct driven bolting arrangement provides for a heavy duty lock mechanism which together with the latching arrangement, which operates when the bolt members are engaged, provides for high security.

Typically, such lock mechanisms include three bolt members—a horizontal bolt member, an upper bolt member and a lower bolt member. A European Standard has made the requirement that application of pressure to the end of the lower bolt member which is able to move the lower bolt member from the engaged position to the disengaged position should not be able to effect movement of the remaining bolt members from the engaged position to the disengaged position.

The present invention therefore seeks to provide a lock mechanism which complies with the European Standard.

SUMMARY OF THE INVENTION

According to a first aspect of the present invention there is provided a lock mechanism for use on a door hinged at a first side, said lock mechanism comprising a first bolt member and at least one further bolt member, each bolt member being movable between an engaged position extending from the door and a disengaged position, each bolt member being arranged to be directly driveable between said engaged and disengaged positions by movement of a drive member, the first bolt member having a first end for engagement with the drive member and a second end remote from the drive member, the first bolt member being adapted to be reduced in length on application of a pressure towards said first end at said second end.

Advantageously the first bolt member is compressible.

Advantageously the first bolt member comprises a first portion and a second portion coupled together so that said second portion moves towards said first portion on application of a pressure towards said first end at said second end. Preferably said second portion is slidably movable with respect to said first portion. Advantageously said first portion and said second portion are coupled together by a compressible link.

Advantageously the lock mechanism further comprises stop means for preventing movement of said second end with respect to said first end beyond a predetermined displacement. Preferably said stop means comprises a stop member for engagement with a fixed part of the lock mechanism which is fixed with respect to the axis of rotation or oscillation of the drive member, the stop member being mounted on the first bolt member. Preferably the stop member is movable between free and stopped positions with respect to the first bolt member, said free position not enabling engagement of the stop member with said fixed part of the lock mechanism and said stopped position enabling engagement of the stop member with said fixed part of the lock mechanism.

Advantageously the stop member is mounted on one of said first and second portions, the other of said first and second portions including maintaining means for maintaining the stop member in said stopped position on application of a pressure towards said first end at said second end. Preferably said maintaining means comprises a projection slidable with respect to said one of said first and second portions. Preferably the projection is slidable in a slot provided in said one of said first and second portions.

Advantageously the stop member is mounted on said first portion.

Advantageously the stop member is pivotable about a pivot point between said free and said stopped positions.

Advantageously the stop member is rotatable about a mounting point between said free and said stopped positions.

Advantageously the stop member is biased towards said free position.

Advantageously said second portion is biased to move away from said first portion.

According to a second aspect of the present invention there is provided a bolt member for a lock mechanism for use on a door hinged at a first side, the bolt member having a first end for engagement with a drive member of the lock mechanism and a second end remote from the first end, the bolt member being adapted to be reduced in length on application of a pressure towards said first end at said second end. Preferably the bolt member is compressible.

Advantageously the bolt member comprises a first portion and a second portion coupled together so that said second portion moves towards said first portion on application of a pressure towards said first end at said second end. Preferably said second portion is slidably movable with respect to said first portion.

Advantageously said first portion and said second portion are coupled together by a compressible link.

Advantageously the bolt member further comprises a stop member for engagement with a fixed part of the lock mechanism which is fixed with respect to the axis of rotation or oscillation of the drive member and for preventing movement of said second end with respect to said first end beyond a predetermined displacement. Preferably the stop member is moveable between free and stopped positions with respect to the first bolt member, said free position not enabling engagement of the stop member with said fixed part of the lock mechanism and said stopped position enabling engagement of the stop member with said fixed part of the lock mechanism.

Advantageously the stop member is mounted on one of said first and second portions, the other of said first and second portions including maintaining means for maintaining the stop member in said stopped position on application of a pressure towards said first end at said second end. Preferably said maintaining means comprise a projection slidable with respect to said one of said first and second portions. Preferably the projection is slidable in a slot provided in said one of said first and second portions.

Advantageously the stop member is mounted on said first portion.

Advantageously the stop member is pivotable about a pivot point between said free and said stopped positions.

Advantageously the stop member is rotatable about a mounting point between said free and said stopped positions.

Advantageously the stop member is biased towards said free position.

Advantageously said second portion is biased to move away from said first portion.

According to a third aspect of the present invention there is provided a lock mechanism for use on a door hinged at a first side, said lock mechanism comprising a first bolt member and at least one further bolt member, each bolt member being movable along a path between an engaged position extending from the door and a disengaged position, each bolt member being arranged to be directly driveable between said engaged and disengaged positions by movement of a drive member, the first bolt member having a first end for engagement with the drive member and a second end remote from the drive member, blocking means for preventing movement of the first bolt member from said engaged to said disengaged position, said blocking means being moveable between a blocking portion in which said blocking means blocks the path of the first bolt member to prevent movement of the first bolt member from said engaged position to said disengaged position and a non-blocking position in which said blocking means does not block the path of the first bolt member, the drive member including a blocking drive member for moving said blocking means from the blocking position to the non-blocking position, the drive member including the blocking drive member being arranged to be operable in response to a single movement of an operating member to allow said blocking means to be moved from the blocking position to the non-blocking position and the bolt members to be driven from said engaged position to said disengaged position. Preferably said blocking means in said blocking position abuts the first bolt member. Preferably said blocking means in said blocking position abuts said first end of the first bolt member.

Advantageously said blocking means is arranged to be responsive to an initial movement of the operating member. Preferably the first bolt member is not responsive to said initial movement of said first operating member.

Advantageously said drive member comprises at least one drive gear for directly driving each bolt member between said engaged and disengaged positions, said at least one drive gear and the blocking drive member being coupled such that initial rotation of the operating member causes rotation solely of the blocking drive member, further rotation of the operating member causing rotation of said at least one drive gear to drive each bolt member between said engaged and disengaged positions. Preferably said at least one drive gear comprises a first drive gear arranged on a common shaft with the blocking drive member, the bore of the first drive gear through which the common shaft extends being shaped to permit initial rotation of the common shaft and the blocking drive member without rotation of the first drive gear.

Embodiments of the present invention will now be described with reference to the drawings, in which:

DETAILED DESCRIPTION OF THE PREFERRED EMBODIMENTS

Figure 1:
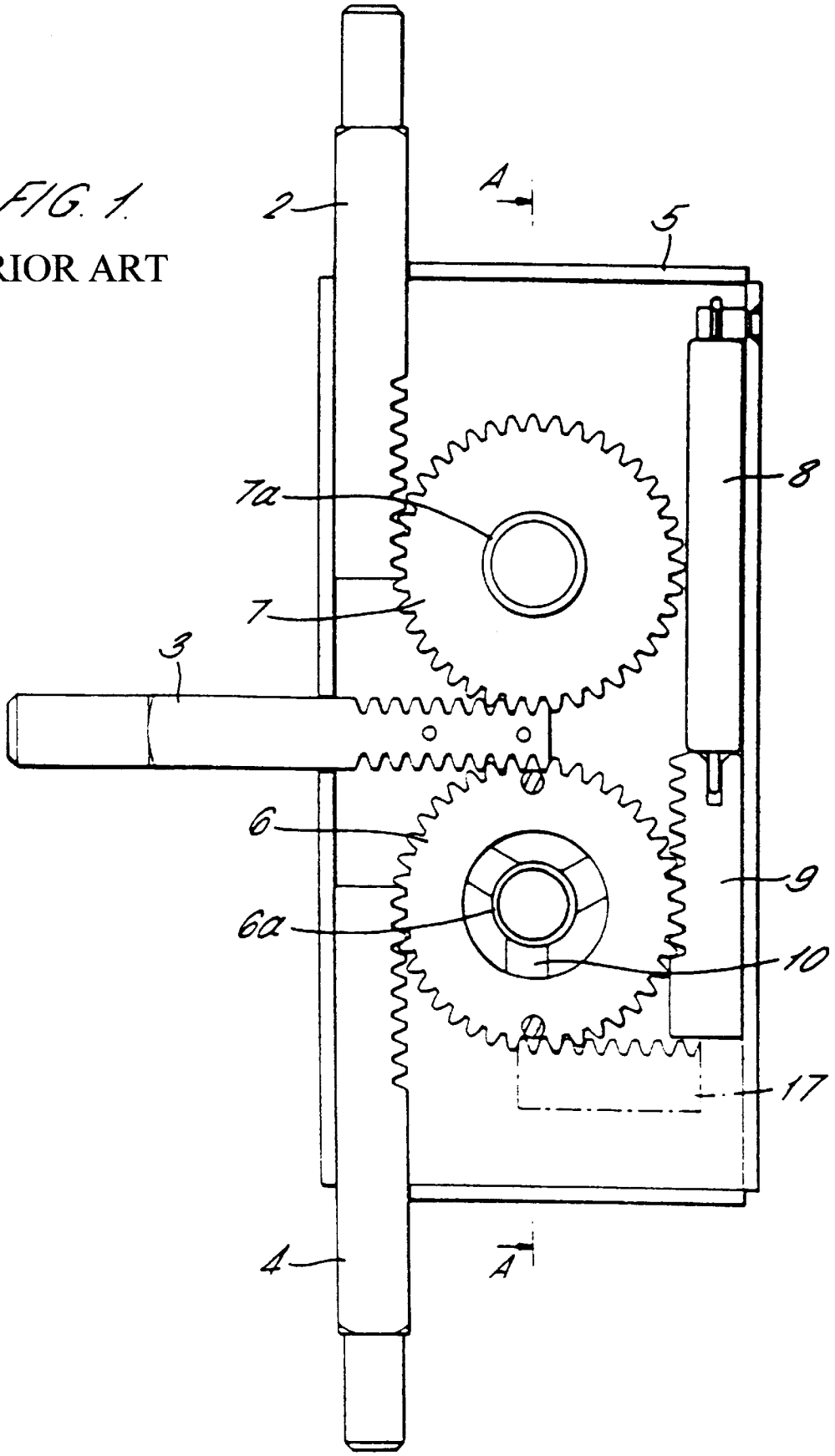
FIG. 1. PRIOR ART
FIG. 1 is an elevational view of a lock mechanism disclosed in GB-A-2289084 with the cover plate removed.
Figure 2:
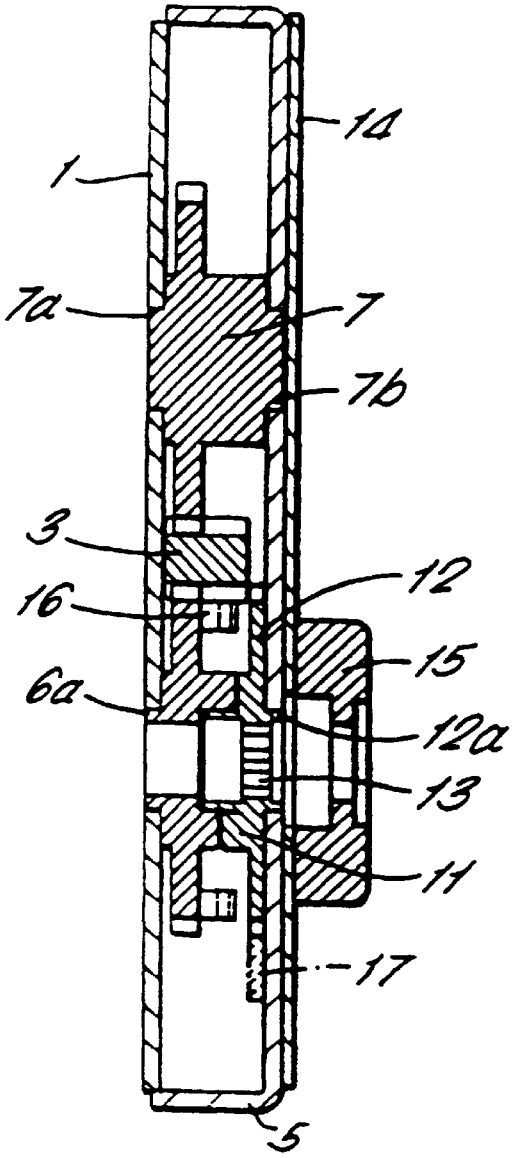
FIG. 2. PRIOR ART
FIG. 2 is a cross-section A—A through FIG. 1.
Figure 3:
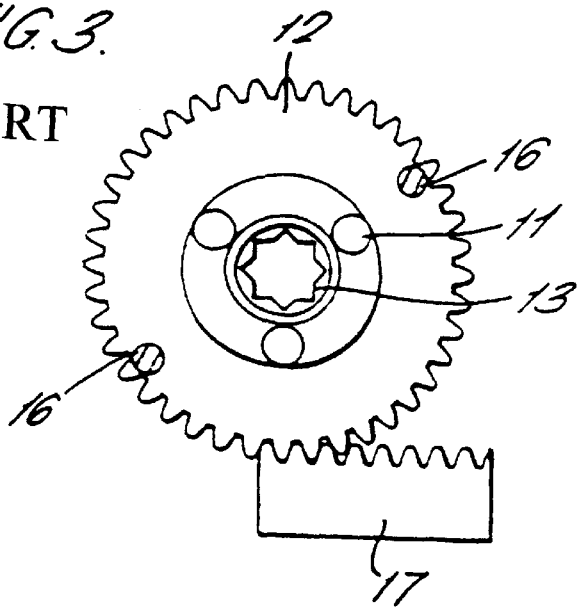
FIG. 3. PRIOR ART
FIG. 3 a view of a prior art latch gear wheel and latch member disclosed in GB-A-2289084.

Referring now to the drawings, FIGS. 1, 2 and 3 illustrate a lock mechanism which can be operated from one side using an operating member to unlatch the bolts when they are in the engaged position and to withdraw the bolts to a disengaged position. The release of the latch mechanism and the retraction of the bolts occurs by a single simple motion of the operating member.

This arrangement can be used for a door providing an emergency exit wherein an operating member is provided only on the inside of the door and no operating member is provided on the outside. From the inside the lock mechanism can be operated simply and quickly by for instance a single push of a release bar, whilst on the outside the lock mechanism is not accessible. Thus from the outside the lock mechanism provides for security since not only is the lock mechanism inaccessible, but also the bolt members which engage the door frame are resistant to end pressure to retract them from the engaged position.

The specific construction of the lock mechanism will now be described with reference to FIGS. 1, 2 and 3.

In FIG. 1 the cover plate 1 which is shown in FIG. 2 is removed to show the construction of the lock mechanism in detail. Three bolt members 2, 3 and 4 project from the housing 5 and are capable of translational motion in and out of the housing 5. Two of the bolt members 2 and 4 move in opposite directions whilst the third bolt member 3 moves in a direction which is generally perpendicular to the opposed directions.

The bolt members 2, 3 and 4 are shown in FIG. 1 to have a fairly short length. However, the lengths of the bolt members 2, 3 and 4 will depend on the door to which the lock mechanism is designed to fit. Normally, the bolt members 2, 3 and 4 will be much longer and will be arranged to engage the top and bottom and one side of the door frame. The remaining side of the door frame is the side on which the door is hinged. Such an arrangement of bolts is a conventional method of providing security and provides a high resistance to a physical attack.

Within the housing 5 there is provided a first drive gear wheel 6 which has a portion 6*a* which fits into a hole in the cover 1 to allow rotation of the first drive gear wheel. Cogs of the first drive gear wheel engage cogs provided along one side of a length of the bolt members 3 and 4 which are arranged generally perpendicularly.

A second drive gear wheel 7 is provided spaced from the first drive gear wheel 6 and has a portion 7*a* which fits in a hole in the cover 1 and a portion 7*b* which fits in a hole in the housing 5 to allow rotation of the second drive gear wheel 7. Cogs of the second drive gear wheel 7 are engaged with cogs provided along a length of the second side of the bolt member 3 and along a side of the bolt member 2. Thus the first and second drive gear wheels are arranged to rotate in opposite directions and the rotation thereof causes translational motion of the bolt members 2, 3 and 4.

The bolt members 2, 3 and 4 are biased in an engaged position by a spring 8 and a spring link member 9 which has cogs provided along a length to engage with the cogs of the first drive gear wheel 6.

The first drive gear wheel 6 is provided with offset slots 10 to receive pins 11 of a latch gear wheel 12. The latch gear wheel 12 has a portion 12*a* which fits into a hole in the housing 5 to allow rotation thereof. The first drive gear wheel 6 and the latch gear wheel 12 are mounted to have the same axis of rotation and support each other in the centre.

In the engaged position shown in FIG. 1 the pins 11 of the latch gear wheel 12 engage the slots 10 in the first drive gear wheel and reside at a position near the anticlockwise sides of the slots.

The latch gear wheel 12 is provided with a splined recess 13 which is designed to receive an operating member such as a handle for rotation of the latch gear wheel 12.

On the outside of the housing 5 there is provided a decorative plate 14 together with a rose plate 15 to support the handle and allow its rotation and operation of the lock mechanism.

The pins 11 of the latch gear wheel 12 are held in their position against the anticlockwise side of the slot 10 in the first drive gear wheel 6 by bias means provided in the form of springs 16 interconnecting the first drive gear wheel 6 and the latch gear wheel 12.

Cogs of the latch gear wheel 12 engage cogs provided on a latch member 17. In the engaged and latch position shown in FIG. 1 the latch member 17 has been extended to the right to prevent movement of the spring link member 9. Before the bolt members 2, 3 and 4 can be retracted to the disengaged position it is necessary to move the latch member 17 to the left to allow the spring link member 9 and hence the drive gear wheels 6 and 7 and the bolt members 2, 3 and 4 to move.

The movement of the latch member is achieved by rotation of the operating member and thus the rotation of the latch gear wheel 12. As the latch gear wheel rotates clockwise the latch gear wheel 17 is moved to the left. The pins 11 of latch gear wheel 12 move clockwise within the slots 10 of the first drive gear wheel until they make contact with the sides of the slots in the clockwise direction. When this occurs the latch member 17 has moved far enough left to be out of the way of the spring link member 9, i.e. it is in the unlatched position, and thus further rotation of the operating member causes the latch gear wheel 12 to drive the first drive gear wheel 6 in the clockwise direction against the spring force of the spring 8 to retract the bolt members 2, 3 and 4.

It can thus be seen that by rotation of an operating member inserted in the splined recess 13 of the latch gear wheel 12, by a single turning motion of the operating member the latch mechanism which holds the bolt members 2, 3 and 4 in the extended position is unlatched and the bolt members 2, 3 and 4 are retracted to release the lock mechanism. Thus during an initial rotation of an operating member the lost motion between the latch gear wheel 12 and the first drive gear wheel 6 is taken up against the biasing action of the spring means 16. Further rotation of the operating member will retract the bolt members 2, 3 and 4 against the biasing of the spring 8. Once the operating member is released the spring 8 will return the bolt members 2, 3 and 4 to the engaged position and as the operating member is further released to its original position the springs 16 will return the lost motion between the latch gear wheel and the first drive gear wheel.

The lock mechanism of FIGS. 1, 2 and 3 provides for a simple lock mechanism whereby no access is required to the mechanism from one side, i.e. outside. Such a lock mechanism can be used for a simple door forming an emergency exit.

Figure 4:
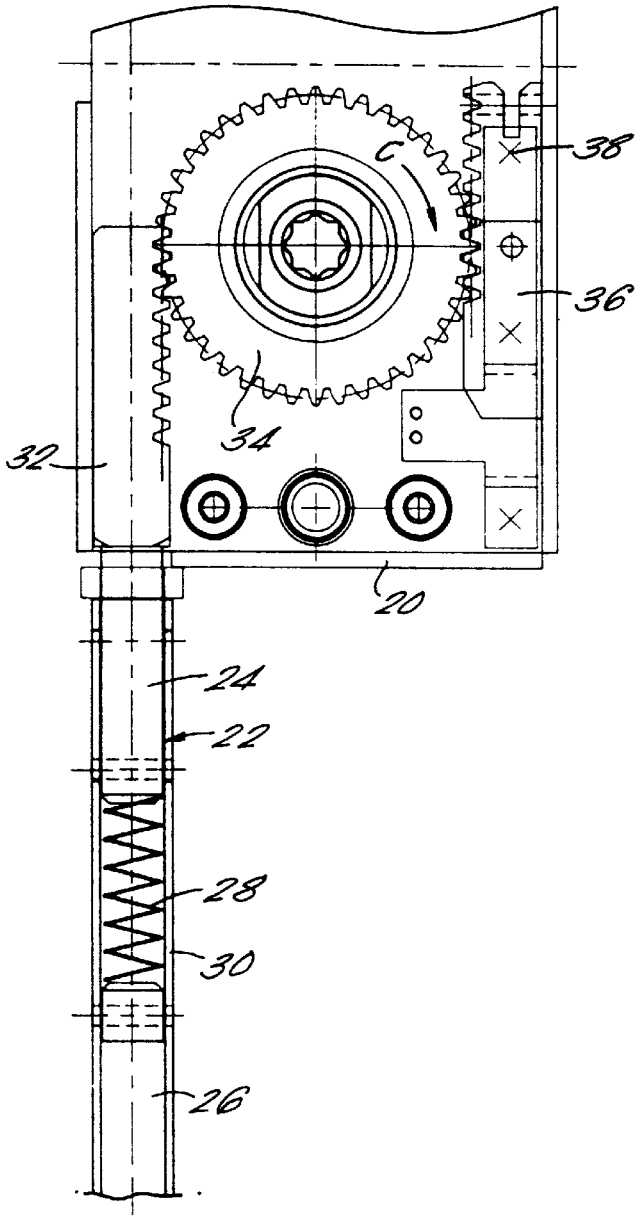
FIG. 4 shows an elevational view of a lock mechanism according to a first embodiment of the present invention.

FIG. 4 shows an elevational view of a lock mechanism according to a first embodiment of the present invention.

The lock mechanism comprises a housing 20 with a lower bolt member 22, upper and horizontal bolt members (not shown) and a drive mechanism within the housing 20 similar to the drive mechanism of FIGS. 1 to 3. However, the embodiment of the present invention shown in FIGS. 4 and 5 may equally be applied to other lock mechanisms having a direct drive mechanism to the bolt members and so the drive mechanism within the housing 20 is not being described in detail.

Essentially, the bolt member 22 is formed as first and second portions 24, 26 coupled together by a compressible portion 28, provided in the specific embodiment as a compressible spring. A guide tube 30 is attached to the housing 20 and guides movement of the first and second portions 24, 26 and the spring 28 in the door when the lock mechanism is being used. The upper end of the bolt member 22 is attached to a rack 32 which engages with a drive gear 34 within the housing 20.

When pressure is applied to the end of the bolt member 22, the second portion 26 is caused to move towards the housing 20 in the sense indicated by the arrow B. Because the first and second portions 24, 26 are coupled together by a compressible spring 28, the pressure applied to the second portion 26 is absorbed by the compressible spring 28 and so the pressure applied to the first portion 24 and the rack 32 is reduced. Advantageously, all of the pressure applied to the end of the bolt member 22 is absorbed by the spring 28 so that the rack 32 does not move at all and so no force is applied to the drive gear 34 which might effect movement of the other bolt members in the lock mechanism.

Alternatively, the drive mechanism within the housing 20 is arranged to resist movement of the bolt member 22 from the engaged position to the disengaged position and so the compression spring 28 is sufficiently compressible so that the pressure transmitted to the rack 32 is insufficient to overcome the resistance to movement provided by the drive mechanism itself. In FIG. 4, this resistance to movement of the bolt member from the engaged position to the disengaged position is provided by a spring link member 36 to which a bias spring (not shown) is attached at an attachment point 38. Cogs provided along a length of the spring link member 36 engage with the cogs of the drive gear 34. The bias spring and spring link member 36 are arranged to resist motion of the drive gear 34 in the sense C and so resist movement of the rack 32 to move the bolt member 22 from the engaged to the disengaged position.

During normal operation of the lock mechanism, an operator turns an operating member (not shown) to rotate the drive gear 34 in the sense indicated by the arrow C and so move the rack 32 further within the housing 20. In the embodiment of FIG. 4, the rack 32 is shown attached to the first portion 24 and so movement of the rack 32 causes the first and second portions 24, 26 and the spring 28 to move within the guide tube 30 and so move the bolt member 22 from the engaged to the disengaged position.

Figure 5:
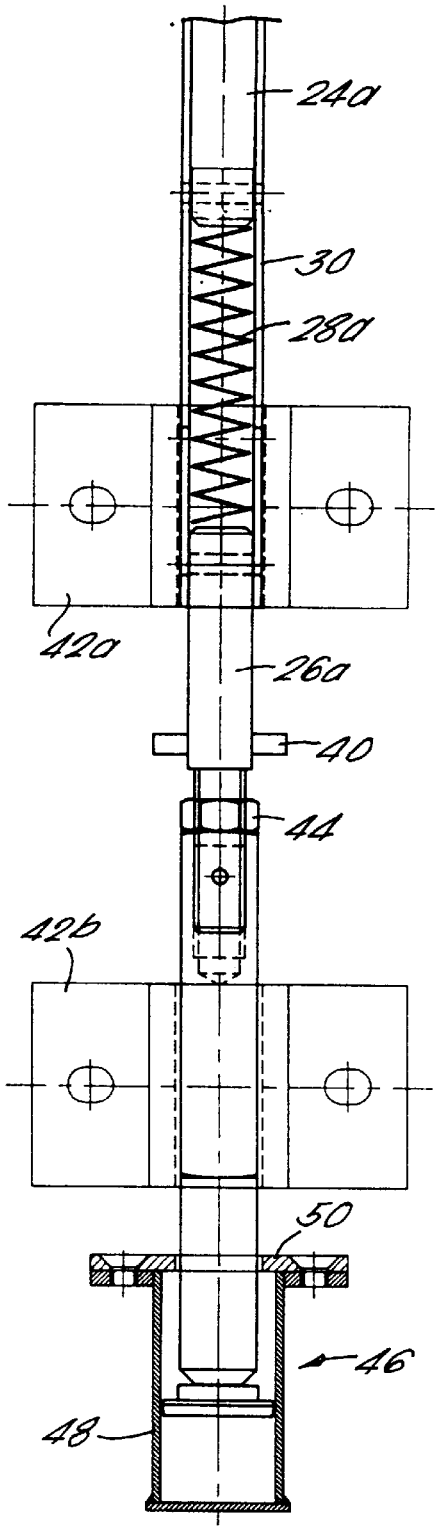
FIG. 5 shows a modification of the embodiment of FIG. 4.

FIG. 5*a* shows a modification of the embodiment of FIG. 4 in which the compressible spring 28*a* is provided further away from the housing 20 than in the embodiment of FIG. 4. Thus, the first portion 24*a* of FIG. 5 is longer than the first portion 24 of FIG. 4 and the second portion 26*a* of FIG. 5 is shorter than the second portion 26 of FIG. 4. Also shown in FIG. 5 is a guide pin 40 for resisting rotation of the bolt member 22 about its longitudinal axis when the bolt member 22 slides within brackets 42*a*, 42*b*. The length of the bolt member 22, as a whole, is adjustable by means of a screw adjustment 44. Also shown in FIG. 5 is a bolt hole guard 46 comprising a cylinder 48 and a cover plate 50 into which the bolt member 22 projects in the engaged position. Depending on the locality of the door to which the lock mechanism is affixed, the bolt hole guard 46 may be provided in a door frame or in the floor.

A disadvantage of the embodiments of FIGS. 4 and 5 is that the compression spring 28 reduces the force transmitted from the end of the bolt member to the rack 32 but may, depending on the characteristics of the compression spring 28 and the clearance of the door from the bolt hole guard, still allow the end of the bolt member 22 to be withdrawn from the bolt hole guard into a disengaged position. Thus, the embodiment of FIGS. 4 and 5 prevents movement of the end of the bolt member 22 from being transmitted to the other bolt members in the lock mechanism but does not necessarily prevent disengagement of the bolt member 22 to which pressure is applied.

FIGS. 6*a*, 6*b*, 6*c*, 6*d* and 7 show a bolt member for a lock mechanism according to a second embodiment of the present invention in which some resistance is provided to movement of the end of the bolt member 60.

Figure 6A:
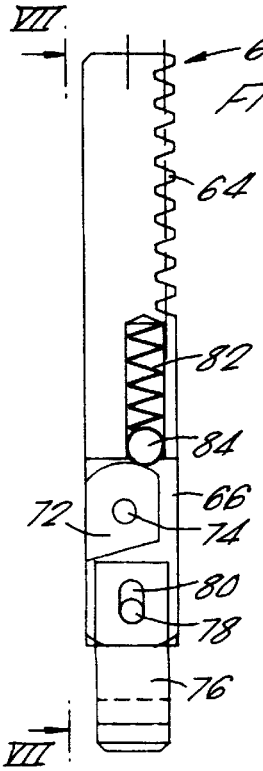
FIG. 6*a* shows a schematic view of a bolt member for a lock mechanism according to a second embodiment of the present invention.

FIG. 6*a* shows the bolt member 60 in a stable configuration in which no pressure is applied to the end of the bolt member 60. A sleeve portion 66, which may be attached to the rack portion 64 or which may form part of the rack portion 64, includes a slit 68 having a closed end 69 and an open end 70. Within the sleeve portion 66 is a cam 72 rotatably mounted on a pin 74. A further portion 76 of the bolt member 60 includes a slide pin 78 which is slidable within a closed slot 80 in the sleeve portion 66. The further portion 76 is therefore able to slide in and out of the sleeve portion 66 with respect to the slide pin 78.

Figure 6B:
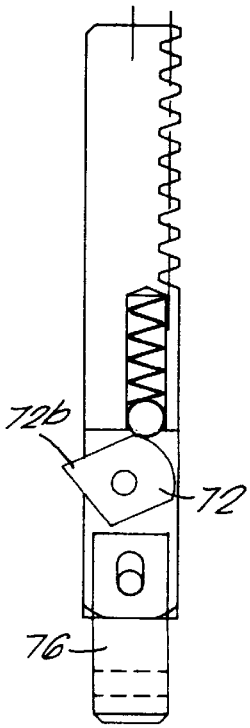
FIGS. 6*b* and 6*c* show schematic views of the bolt member of FIG. 6*a* in different configurations.
Figure 6C:
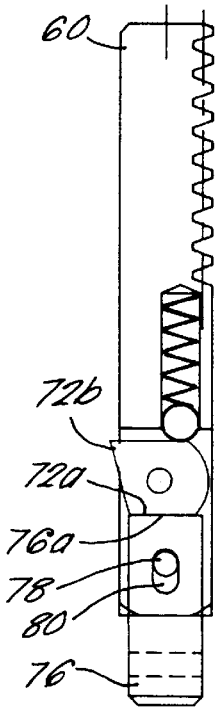
Figure 6D:
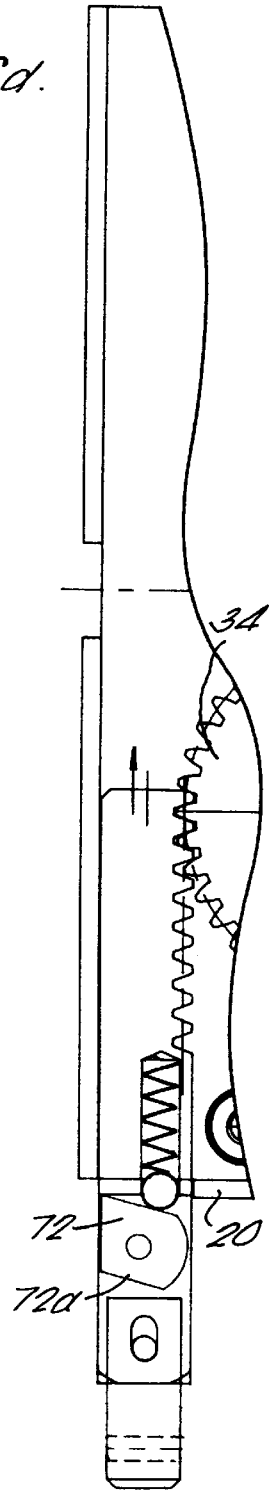
FIG. 6*d* shows a schematic view of the bolt member of FIG. 6*a* in a further configuration and in relation to the housing of the lock mechanism (shown in part) according to the second embodiment of the present invention.
Figure 7:
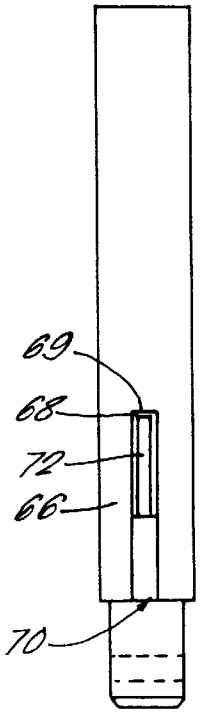
FIG. 7 shows a view of the bolt member of FIG. 6*a* along the line VII—VII of FIG. 6*a;*

Bias means, comprising a spring 82 and a ball 84, mounted within the rack portion 64 are effective to bias the position of the cam 72 to the positions shown in FIGS. 6*a* and 6*d*.

FIG. 6*d* shows the bolt member 60 in a stable configuration in which no pressure is applied to the end of the bolt member 60. Pressure is applied by the spring 82 to maintain the cam 72 in a position with all of its edges within the sleeve portion 66. The bolt member 60 can therefore be easily moved between the engaged and disengaged positions using a drive gear 34.

In the configuration of FIG. 6*c*, as can be seen from the position of the pin 78 within the slot 80, pressure has been applied to the bottom end of the bolt member 60. With the upward movement of the further portion 76, an end 76*a* of the further portion 76 pushes against a side 72*a* of the cam 72, thus rotating the cam 72 about the pin 74. A corner 72*b* of the cam is thereby caused to protrude out of the sleeve portion 66 through the slit 68. Further upward movement of the cam 72, and therefore of the further portion 76 is prevented because the corner 72*b* of the cam 72 cannot move further against the cover panel 86 of the housing 20. As movement of the bolt member 60 relative to the housing 20 is prevented, the rack portion 62 is not caused to move upward by application of pressure at the end of the bolt member 60 and so the other bolt members in the lock mechanism are not affected.

When the end of the bolt member 60 is released, the cam 72 may return to the position shown in FIG. 6*d*.

It is conceivable that the cam 72 may be caused to move into the configuration shown in FIG. 6*b*. With this configuration also, a corner 72*b* of the cam projects out of the sleeve portion 66 and so excessive upward motion of the further portion 76 is prevented. However, should the bolt member 60 be caused to move upward by the drive wheel 34, then it is possible for the cam 72 to rotate in the slit 68 so that the corner 72*b* is no longer protruding from the sleeve portion 66. The bolt member 60 can therefore be retracted (moved from the engaged position to the disengaged position) from the configurations shown in either FIGS. 6*a* or 6*b*.

Figure 8A:
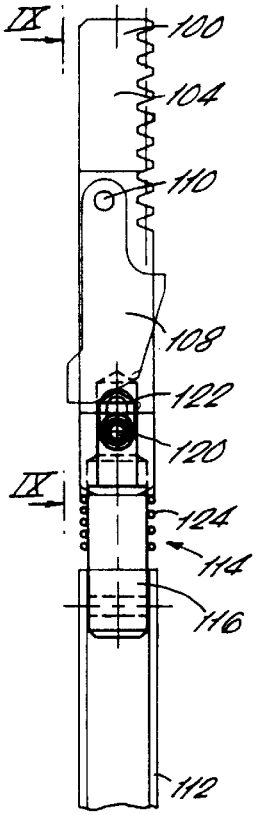
FIGS. 8*a* and 8*b* shows a schematic view of a bolt member in different configurations for a lock mechanism according to a third embodiment of the present invention.
Figure 8B:
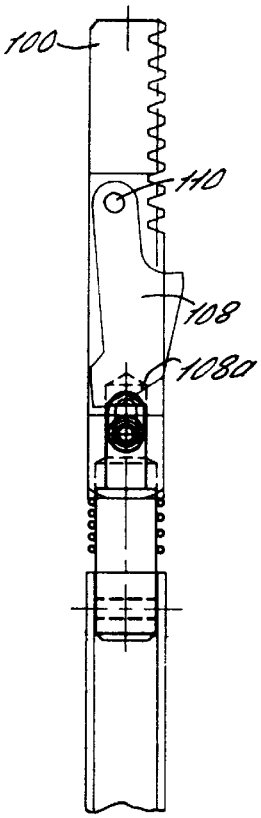
Figure 8C:
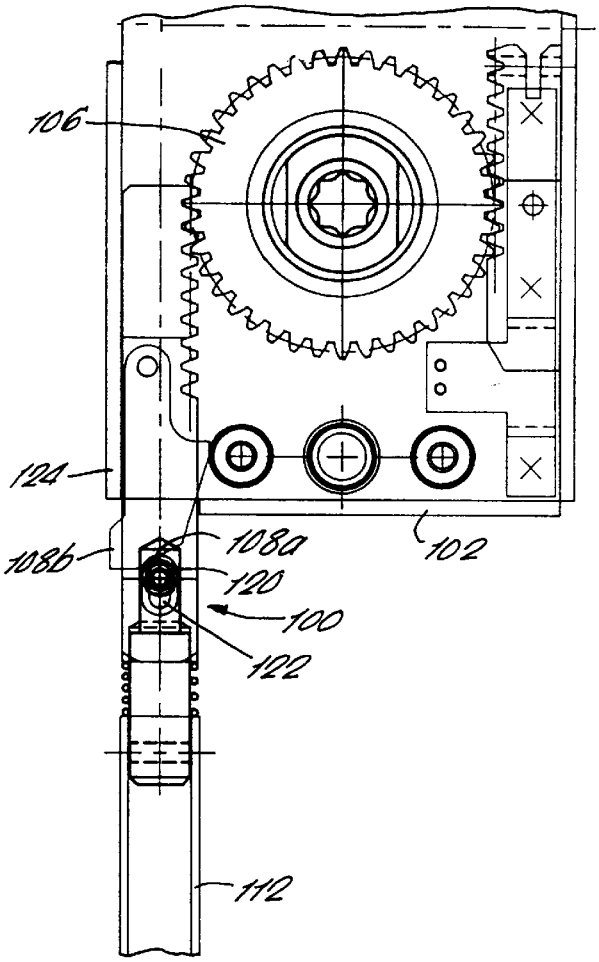
FIG. 8*c* shows a schematic view of the bolt member of FIGS. 8*a* and 8*b* in a further configuration and in relation to the housing of a lock mechanism (shown in part) according to the third embodiment of the present invention.
Figure 9:
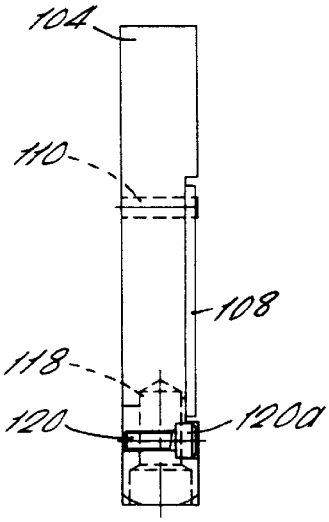
FIG. 9 shows a view of the bolt member of FIGS. 8*a* and 8*b* along the line IX—IX of FIG. 8*a;*

FIGS. 8*a* and 8*b* show a schematic view of a bolt member 100 for a lock mechanism according to a third embodiment of the present invention. The bolt member 100 is shown in relation to the housing 102 of a lock mechanism in FIG. 8*c*. The lock mechanism further comprises upper and horizontal bolt members (not shown) and a drive mechanism within the housing 102 similar to the drive mechanism of FIGS. 1 to 3. However, the embodiment of the present invention shown in FIGS. 8*a*, 8*b*, 8*c* and 9 may equally be applied to other lock mechanisms having a direct drive mechanism to the bolt members and so the drive mechanism within the housing 102 is not being described in detail. The upper end of the bolt member 100 includes a rack portion 104 which engages with a drive gear 106 within the housing 102.

The bolt member 100 is recessed to accommodate a rocking cam 108 which rocks or pivots about a pin 110 extending through the bolt member 100.

The rack portion 104 is coupled to a further portion 112 of the bolt member 100 by a compressible link 114. The compressible link 114 comprises a link member 116 with one end of the link member 116 fixedly attached to the further portion 112. The other end of the link member 116 is shaped to be received in a blind recess 118 in the rack portion 104. The link member 116 is mounted in the rack portion 104 by a pin 120 which is slidable within a slot 122 in the rack portion 104.

FIGS. 8*a* and 8*b* show the bolt member 100 respectively in the engaged position and in the disengaged position. In the configuration shown in FIG. 8*c*, pressure has been applied to the bottom end of the bolt member 100 to move the further portion 112 towards the housing 102. This pressure is transmitted through the link member 116 to move the pin 120 of the link member 116 towards the housing 102 relative to the rack portion 104. The pin head 120*a* of the pin 120 co-operates with a face 108*a* of the cam 108 to hold the cam 108 in the position shown in FIGS. 8*a* and 8*c*. In this configuration, a stop portion 108*b* of the cam 108 protrudes from the rack 104 to abut against the cover panel 124 of the housing 102. Abutment of the stop portion 108*b* against the cover panel 124 prevents further pressure applied to the end of the bolt member 100 from being transmitted through the rack portion 104 to move the drive gear 106. In this way, the other bolt members in the locking mechanism are unaffected by the application of pressure to the end of the bolt member 100.

As can be seen in FIGS. 8*a* and 8*b*, when pressure is not applied to the end of the bolt member 100, there is sufficient clearance between the cam 108 and the pin head 120*a* for the cam 108 to rock between the position shown in FIGS. 8*a* and 8*b*.

Figure 11:
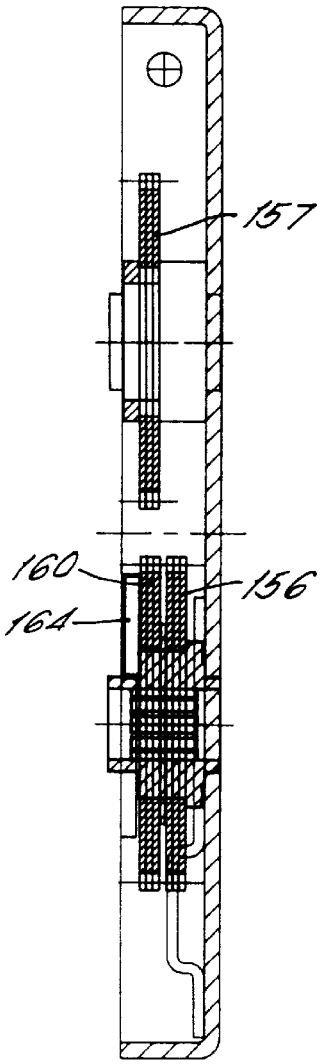
FIG. 11 shows a part cross-section through FIG. 10.
Figure 10:
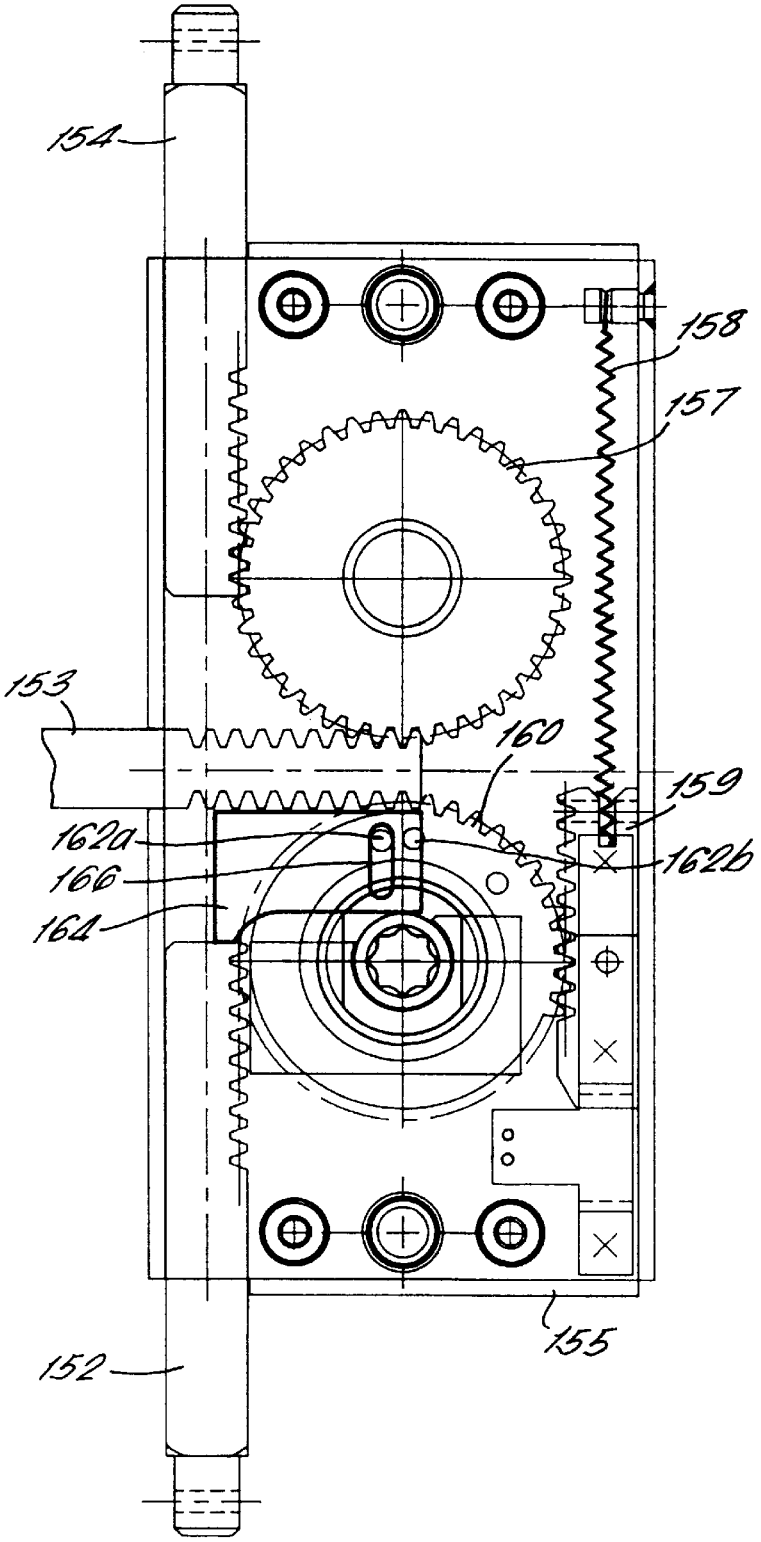
FIG. 10 shows an elevational view of a lock mechanism according to a fourth embodiment of the present invention.

In FIGS. 10 and 11, the cover plate (which would be on the left-hand side of the section of FIG. 11) is removed to show the construction of the lock mechanism in detail. Three bolt members 152, 153 and 154 project from the housing 155 and are capable of translational motion in and out of the housing 155. Two of the bolt members 152 and 154 move in opposite directions whilst the third bolt member 153 moves in a direction which is generally perpendicular to the opposed directions.

The bolt members 152, 153 and 154 are shown in FIG. 10 to have a fairly short length. However, the lengths of the bolt members 152, 153 and 154 will depend on the door to which the lock mechanism is designed to fit. Normally, the bolt members 152, 153 and 154 will be much longer and will be arranged to engage the top and bottom and one side of the door frame. The remaining side of the door frame is the side on which the door is hinged. Such an arrangement of bolts is a conventional method of providing security and provides a high resistance to a physical attack.

Within the housing 155 there is provided a first drive gear wheel 156. Cogs of the first drive gear wheel 156 engage cogs provided along one side of a length of the bolt members 152 and 153 which are arranged generally perpendicularly.

A second drive gear wheel 157 is provided spaced from the first drive gear wheel 156. Cogs of the second drive gear wheel 157 are coupled to be engaged with cogs provided along a length of the second side of the bolt member 153 and along a side of the bolt member 154. Thus the first and second drive gear wheels are arranged to rotate in opposite directions and the rotation thereof causes translational motion of the bolt members 152, 153 and 154.

The bolt members 152, 153 and 154 are biased in an engaged position by a spring 158 and a spring link member 159 which has cogs provided along a length to engage with the cogs of the first drive gear wheel 156.

The lock mechanism further includes a restraint gear wheel 160 on which is mounted a pin 162. A restraint cam 164 includes a slot 166 through which the pin 162 projects. As the restraint gear wheel 160 is rotated (clockwise in FIG. 10), the pin 162 causes the restraint cam 164 to move.

In the configuration shown in FIG. 10, the bolt members 152, 153 and 154 are in the engaged position. The restraint cam 164 is effective to prevent movement of the lower bolt member 152 from the engaged position to the disengaged position against the application of a force at the end of the lower bolt member 152.

To unlock the lock mechanism, an operating member having a handle with a cross-section to fit through the hole 166 in the restraint gear wheel 160 is rotated. Rotation of the restraint gear wheel 160 in the clockwise sense (as shown in FIG. 10) causes the pin 162 to move from the position 162*a* shown in FIG. 10 to the position 162*b* in FIG. 10 thereby moving the restraint cam 164 so that it does not prevent movement of the lower bolt member 152.

Figure 12A:
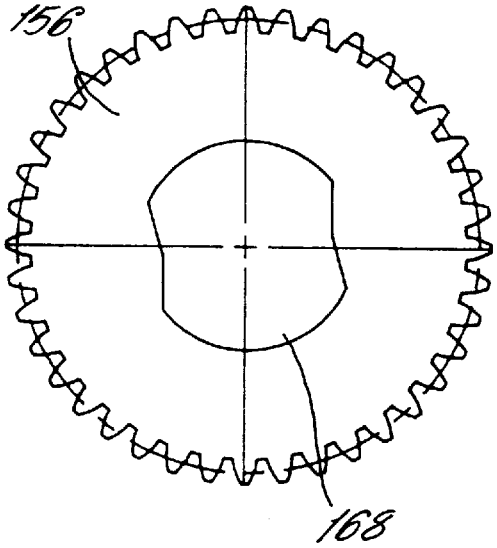
FIGS. 12*a* and 12*b* show gear wheels for use with the embodiment of FIGS. 10 and 11.
Figure 12B:
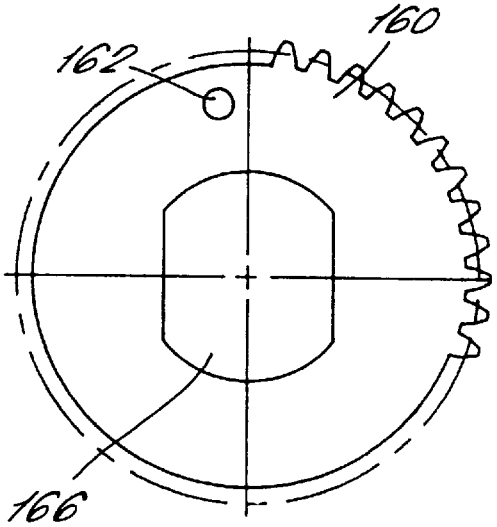

Because of the relative shapes of the hole 166 in the restraint gear 160 and the hole 168 in the first drive gear wheel 156 as shown in FIGS. 12*a* and 12*b*, initial rotation of the restraint gear wheel 160 to move the pin 162 from 162*a* to 162*b* has no effect on the first drive gear wheel 156. As the pin 162 and restraint cam 164 are moved to allow movement of the lower bolt member 152, the handle of the operating member picks up the first drive gear wheel 156 effecting rotation of the first gear wheel 156 with corresponding movement of the lower bolt member 152, the other bolt members 153, 154 and the second drive gear wheel 157 to effect disengagement of the bolt members 152, 153, 154.

It can thus be seen that by rotation of an operating member inserted in the hole 166 of the restraint gear wheel 160, by a single turning motion of the operating member the restraint cam 164 which holds the bolt member 152 in the extended position is released and the bolt members 152, 153 and 154 are retracted to release the lock mechanism. Thus during an initial rotation of an operating member the lost motion between the restraint gear wheel 160 and the first drive gear wheel 156 is taken up. Further rotation of the operating member will retract the bolt members 152, 153 and 154 against the biasing of the spring 158. Once the operating member is released the spring 158 will return the bolt members 152, 153 and 154 to the engaged position and as the operating member is further released to its original position the lost motion between the restraint gear wheel 160 and the first drive gear wheel 156 will be returned.

Figure 13A:
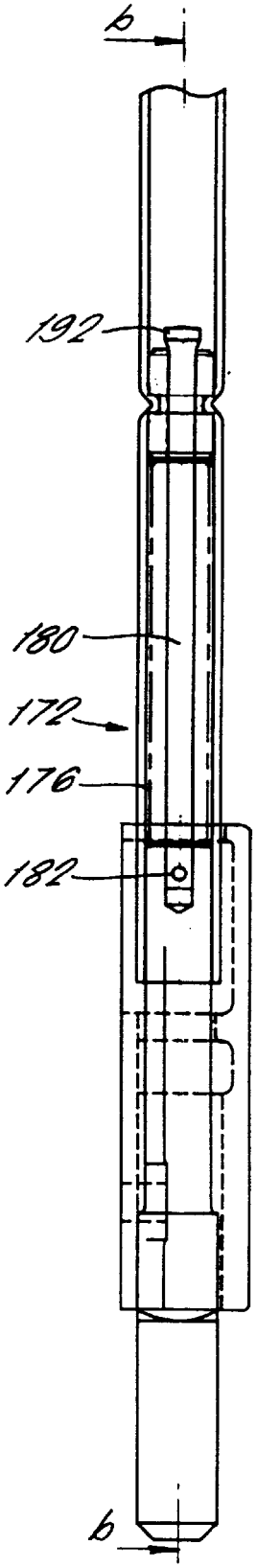
FIG. 13*a* is a cross section of a fifth embodiment of the invention.
Figure 13B:
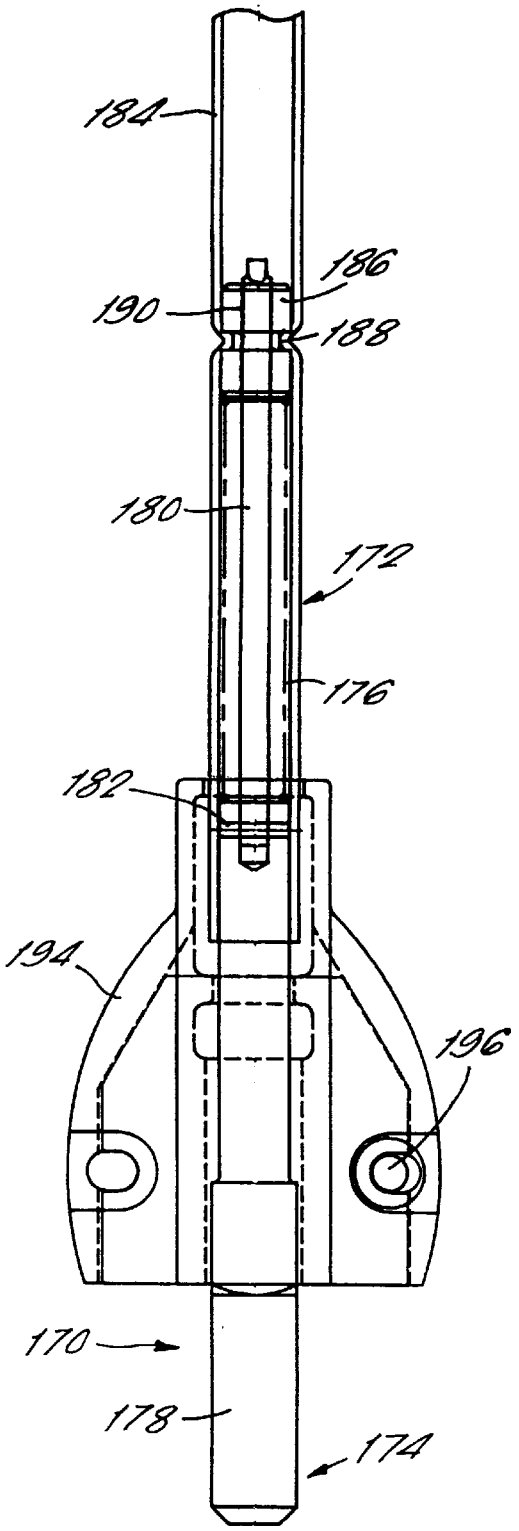
FIG. 13*b* is a cross section along line b—b in FIG. 13*a*.

A fifth embodiment of the invention is shown in FIGS. 13*a* and 13*b*. This embodiment is similar in principle to the first embodiment in that it has a bolt member 170 formed as first and second portion 172, 174 coupled together by a compressible portion 176, provided in the specific embodiment as a compressible spring. In this case, the first bolt portion 174 consists of a head 178 to which a stem 180 is fixed by a pin 182. The second bolt member 172 comprises a tubular member 184 and a cylindrical insert 186. The insert 186 has a peripheral groove 188 and a through bore 190.

To assemble the bolt member 170 the stem 180 is fitted through the through bore 190 of the insert 186. The stem 180 has an enlarged head 192 which prevents it from sliding right through the through bore 190 of the insert. The spring 176 is then placed over the stem 180 and abuts the insert 186. The head 178 is then inserted through the lower end of housing 194 with its upper end protruding. The upper end is pinned to the stem 180 by pin 182 so that the spring 176 is sandwiched between the insert 186 and head 178. The tubular member 184 is then fitted over this and crimped adjacent to the groove 188 in the insert so as to fix the insert 186 and tubular member 184 against relative sliding movement. The bolt member 170 can thus be slideably retained on a door by the housing 194 which is fixed to the door by fasteners through fastening holes 196.

The head 178 of the bolt member 170 is moved into the engaged position shown in FIGS. 13*a* and 13*b* by movement of the tubular member 184 by a drive gear similar to that described in earlier examples. The spring 176 has sufficient strength to transmit this movement to the second portion 174. On the other hand, when upward pressure is applied to the head 178, the first member 170 moved upwardly compressing the spring 176 which is sized to absorb the upward movement.

This embodiment is cheap to assemble and is reliable to operate as the spring 176 is retained between the tubular member 184 and the stem 180.

What is claimed is:

1. A bolt adapted to fasten two members together, the bolt being further adapted to slide on a surface of a first member from a first configuration to a locked configuration and from the locked configuration to the first configuration, wherein a distal end of the bolt is adapted to project into a second member when the bolt is in the locked configuration;

the bolt comprising first and second telescopic portions urged apart from one another by a resilient member configured such that pressure on the distal end of the bolt towards a proximal end will cause compression of the resilient member instead of corresponding movement of the proximal end of the bolt;

the resilient member being contained within a tubular member that forms a part of said first telescopic portion; and an insert retained in said tubular member, the insert having a through bore in which the second telescopic portion is slidably retained, the resilient member operating between an end of the insert and a facing on the second telescopic portion.

2. A method of assembling a bolt according to claim 1, the method comprising the steps of inserting a proximal end of a head portion of the second telescopic portion into a housing in which it is slidably retained; fitting the insert over a stem, such that the stem is slidable with respect to the insert but is retained thereon by virtue of an enlarged head at one end of the stem; fitting the resilient member over the stem so that it abuts the insert; fixing the end of the stem remote from the enlarged head into the head portion such that the resilient member is retained between the insert and the proximal end of the head portion; fitting the insert and stem into the tubular member and crimping the tubular member so that the insert is fixably retained with respect to the tubular member, wherein the insert and tubular member form the first telescopic portion while the head portion and stem form the second telescopic portion.

* * * * *